US011242860B2

(12) United States Patent
Il

(10) Patent No.: US 11,242,860 B2
(45) Date of Patent: Feb. 8, 2022

(54) FUEL PUMP

(71) Applicant: AISAN KOGYO KABUSHIKI KAISHA, Obu (JP)

(72) Inventor: Seiji Il, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 6 days.

(21) Appl. No.: 16/500,008

(22) PCT Filed: Mar. 13, 2018

(86) PCT No.: PCT/JP2018/009806
§ 371 (c)(1),
(2) Date: Oct. 1, 2019

(87) PCT Pub. No.: WO2018/186124
PCT Pub. Date: Oct. 11, 2018

(65) Prior Publication Data

US 2020/0109716 A1 Apr. 9, 2020

(30) Foreign Application Priority Data

Apr. 7, 2017 (JP) ..... JP2017-077073

(51) Int. Cl.
*F04D 29/20* (2006.01)
*F04D 29/044* (2006.01)
*F04D 29/18* (2006.01)

(52) U.S. Cl.
CPC ..... *F04D 29/20* (2013.01); *F04D 29/044* (2013.01); *F04D 29/188* (2013.01); *F05D 2240/60* (2013.01)

(58) Field of Classification Search
CPC ..... F04D 29/20; F04D 29/044; F04D 5/002; F04D 29/188; F05D 2260/36; F05D 2240/60

(Continued)

(56) References Cited

U.S. PATENT DOCUMENTS 5,174,713 A 12/1992 Iwai et al.
2008/0085181 A1* 4/2008 Hanai ..... F04D 29/0413 415/55.5
2018/0142653 A1* 5/2018 Hidaka ..... F04D 13/06

FOREIGN PATENT DOCUMENTS

JP S50-015207 Y1 5/1975
JP S55-110797 U 8/1980

(Continued)

OTHER PUBLICATIONS

Written Opinion (English Translation) for PCT/JP2018/009806 dated Jun. 12, 2018 (8 pages).

(Continued)

*Primary Examiner* — Courtney D Heinle
*Assistant Examiner* — Andrew J Marien
(74) *Attorney, Agent, or Firm* — Shumaker, Loop & Kendrick, LLP

(57) ABSTRACT

A fuel pump includes an output shaft of a motor and an impeller configured to rotate integrally with the output shaft. An outer periphery of the output shaft includes a first flat portion for engaging with the impeller. The impeller includes a through hole at a center thereof, the through hole being larger than an outer diameter of the output shaft and including a second flat portion for engaging with the output shaft. In this fuel pump, when the output shaft and the impeller are arranged coaxially, spots exist which have different lengths of a gap between the first flat portion and the second flat portion in a rotational axis direction of the output shaft.

4 Claims, 6 Drawing Sheets

(58) Field of Classification Search
USPC ..... 415/90; 416/204 R
See application file for complete search history.

(56) References Cited

FOREIGN PATENT DOCUMENTS

| | | | |
|---|---|---|---|
| JP | H4-024698 | U | 2/1992 |
| JP | H4-066797 | A | 3/1992 |
| JP | H11-082208 | A | 3/1999 |
| JP | 2004-324490 | A | 11/2004 |
| JP | 2013-234630 | A | 11/2013 |

OTHER PUBLICATIONS

International Search Report (ISR) for PCT/JP2018/009806 dated Jun. 12, 2018 (4 pages total including English translation).

* cited by examiner

FUEL PUMP

TECHNICAL FIELD

The technology disclosed herein relates to a fuel pump.

BACKGROUND ART

Japanese Patent Application Publication No. H4-66797 (hereinafter, Patent Literature 1) describes a fuel pump. The fuel pump in Patent Literature 1 has an output shaft extending from a motor, and this output shaft is engaged with an impeller and rotates the impeller. The impeller includes a through hole into which the output shaft is to be inserted. Further, in order to prevent the output shaft from running idle, each of the output shaft and the through hole includes a flat portion.

SUMMARY OF INVENTION

In the fuel pump of Patent Literature 1, a part of the output shaft which includes the flat portion has a regular shape along a rotational axis direction of the output shaft. Further, the through hole has a regular shape along a central axis direction of the impeller (direction perpendicular to a surface of the impeller). That is, the flat portion of the output shaft extends parallel to the rotational axis of the output shaft, and the flat portion of the through hole extends parallel to the central axis of the impeller. Due to this, when the output shaft and the impeller are arranged coaxially (arranged such that the rotational axis of the output shaft and the central axis of the impeller coincide with each other), the flat portion of the output shaft and the flat portion of the through hole become parallel to each other. It should be noted that, when the fuel pump is in operation, the arrangement of the output shaft and the impeller does not remain coaxial. That is, the impeller rotates with the central axis thereof tilting relative to the rotational axis of the output shaft. The tilting central axis of the impeller relative to the rotational axis of the output shaft brings the output shaft and the impeller into contact with each other at plural spots in the rotational axis direction of the output shaft. Movement of the impeller (movement to tilt relative to the output shaft) is restricted when the output shaft and the impeller come into contact at the plural spots in the rotational axis direction of the output shaft. If the fuel pump continues to operate in such state, the output shaft and the impeller could be stuck to each other (both immobilized), and the impeller could become immobile relative to the output shaft. The present disclosure discloses a fuel pump capable of suppressing an output shaft and an impeller from being stuck to each other.

The fuel pump disclosed herein may comprise an output shaft of a motor, and an impeller configured to rotate integrally with the output shaft. An outer periphery of the output shaft may comprise a first flat portion for engaging with the impeller. A center of the impeller may comprise a through hole being larger than an outer shape of the output shaft and comprising a second flat portion for engaging with the output shaft. Further, in the fuel pump disclosed herein, when the output shaft and the impeller are arranged coaxially, spots which have different lengths of a gap between the first flat portion and the second flat portion in a rotational axis direction of the output shaft may exist. It should be noted that "the output shaft and the impeller are arranged coaxially" means that the output shaft and the impeller are arranged such that a rotational axis of the output shaft and a central axis of the impeller coincide with each other.

The above fuel pump comprises, in the rotational axis direction, the spots which have different lengths of the gap between the first flat portion and the second flat portion from one another. That is, there exist in the rotational axis direction of the output shaft a spot at which the gap between the first flat portion and the second flat portion is wide, and a spot at which the gap between the first flat portion and the second flat portion is narrow. Due to this, the output shaft and the impeller make contact at the spot at which the gap is narrow in the rotational axis direction. The spot where the output shaft and the impeller resultingly come into contact with each other is accordingly localized in the rotational axis direction, as a result of which movement of the impeller is less hindered, and the output shaft and the impeller can be suppressed from being stuck to each other.

The output shaft may comprise portions which have different lengths between the rotational axis of the output shaft and the first flat portion in the rotational axis direction. That is, a shape of the output shaft in a cross-section perpendicular to the rotational axis may differ in the rotational axis direction of the output shaft. A process to form the first flat portion can be realized by simply reducing an outer surface (peripheral surface) of the output shaft. Since the process of reducing the outer surface of the output shaft is relatively easy to perform, the first flat portion can be formed with high precision. It should be noted that, "length between the rotational axis of the output shaft and the first flat portion" means a shortest length between the rotational axis and the first flat portion in a plane perpendicular to the rotational axis of the output shaft.

The impeller may comprise portions which have different lengths between the central axis of the impeller and the second flat portion in a central axis direction of the impeller. That is, shapes of the through hole in a cross-section perpendicular to the central axis of the impeller may be different in the central axis direction of the impeller. The length between the central axis of the impeller and the second flat portion can be changed in the central axis direction of the impeller by adjusting a mold for molding the impeller (or a component including a through hole). That is, a post-processing for forming the second flat portion after forming the impeller (or the component including the through hole) can be dispensed with.

DESCRIPTION OF EMBODIMENTS

Figure 7:
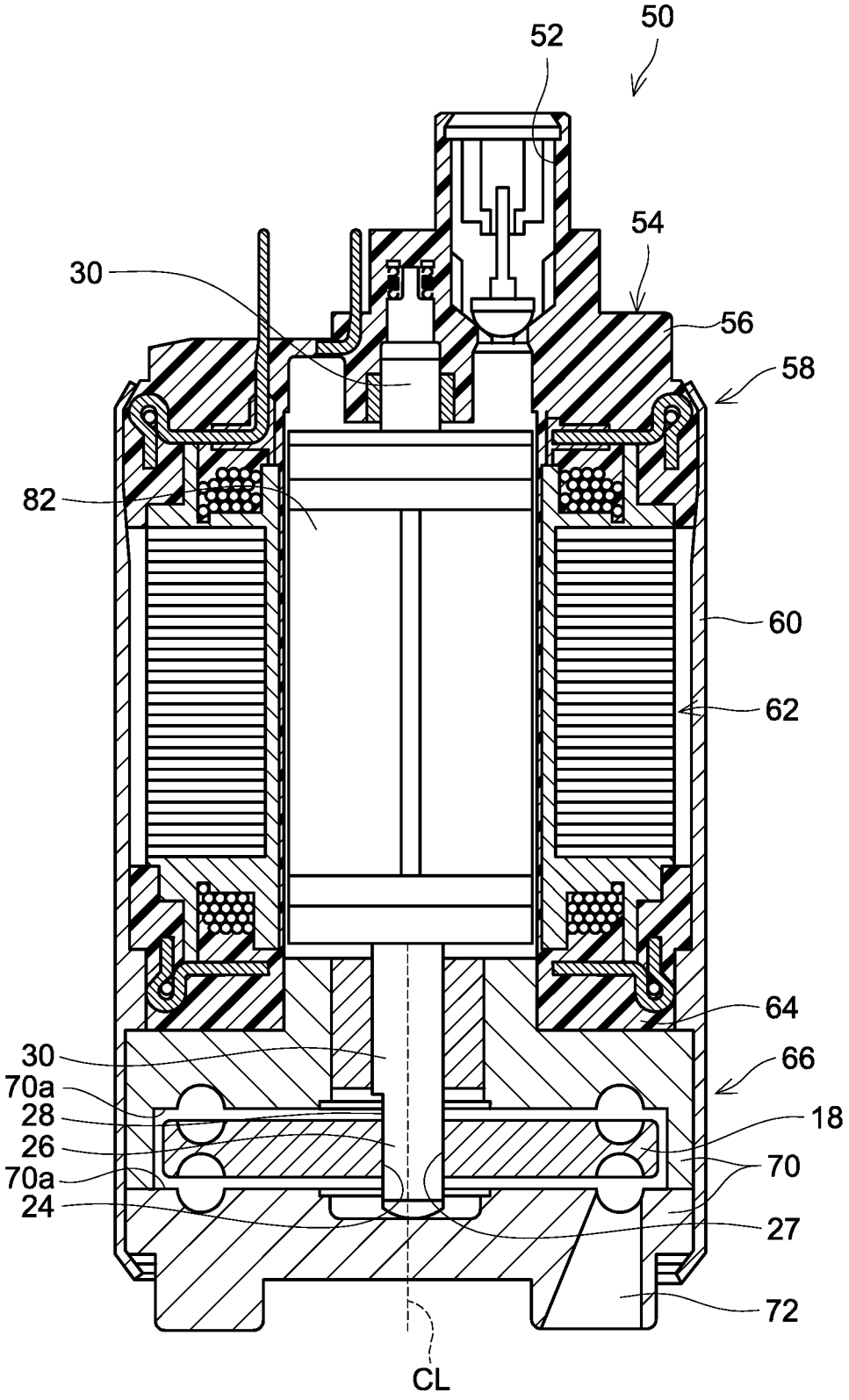
FIG. 7 shows a diagram for describing a basic structure of a fuel pump.

Firstly, in order to describe a basic structure of a fuel pump, a fuel pump 50 shown in FIG. 7 will be described. The fuel pump 50 is an example of a fuel pump disclosed herein. The fuel pump 50 comprises a motor section 58 and a pump section 66. The motor section 58 and the pump section 66 are disposed in a housing 60. The housing 60 has a cylindrical shape with openings at its opposing ends.

The motor section 58 constitutes a brushless three-phase motor. The motor section 58 comprises a rotor 82 and a stator 62. The rotor 82 comprises a permanent magnet. An output shaft 30 extends through and is fixed to a center of the rotor 82. The output shaft 30 has an engaging portion 26 inserted into a through hole 27 provided at a center of an impeller 18 and engaged with the impeller 18. Due to this, the impeller 18 rotates integrally with the output shaft 30. It should be noted that, a size of the through hole 27 is larger than a size (outer shape) of the engaging portion 26. Due to this, the impeller 18 is capable of moving relative to the output shaft 30. The rotor 82 is supported rotatably around a rotational axis CL of the output shaft 30 by bearings disposed at opposing ends of the output shaft 30. The stator 62 is fixed inside the housing 60 by a plastic layer 54.

The pump section 66 comprises a casing 70 and the impeller 18. The casing 70 closes the opening of a lower end of the housing 60. An intake port 72 is provided at a lower end of the casing 70. The intake port 72 is connected to a secondary tank (not illustrated) disposed in a fuel tank. Fuel within the fuel tank is sucked into the pump section 66 through the intake port 72. The impeller 18 is housed in the casing 70. A gap is provided between an inner surface 70*a* of the casing 70 and a surface of the impeller 18. An outer peripheral surface of the engaging portion 26 includes a first flat portion 28, and an inner peripheral surface of the through hole 27 includes a second flat portion 24, details of which will be described later.

The plastic layer 54 comprises an upper end plastic portion 56 and a lower end plastic portion 64 respectively disposed at an upper end and a lower end of the stator 62. The upper end plastic portion 56 closes the opening of an upper end of the housing 60. An exhaust port 52 is provided on an upper surface of the upper end plastic portion 56. The exhaust port 52 is an opening for discharging fuel pressurized in the pump section 66 to outside.

Figure 8:
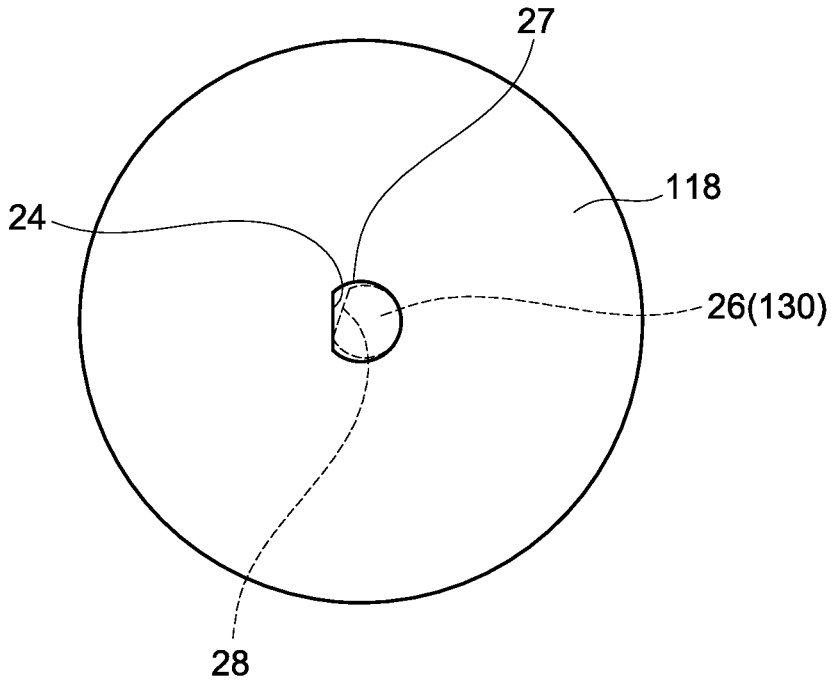
FIG. 8 shows a state where an output shaft and an impeller in a conventional fuel pump are engaged.
Figure 9:
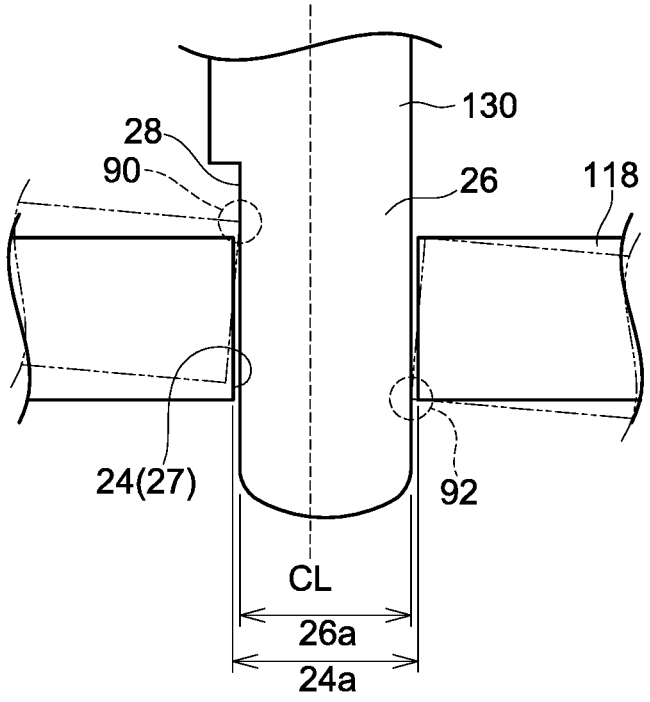
FIG. 9 shows a state where the output shaft is inserted into a through hole of the impeller in the conventional fuel pump.
Figure 10:
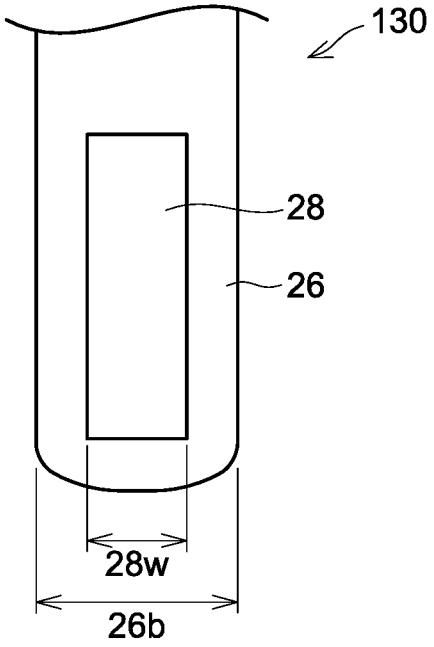
FIG. 10 shows a side surface of the output shaft used in the conventional fuel pump.

Next, with reference to FIGS. 8 to 10, how an output shaft 130 and an impeller 118 are engaged in a conventional fuel pump will be described. FIG. 8 shows a state of an engaging portion 126 of the output shaft 130 and the impeller 118, as observed along a rotational axis direction of the output shaft 130. FIG. 9 shows a state of the output shaft 130 and the impeller 118 as observed along a direction perpendicular to a rotational axis CL of the output shaft 130. FIG. 10 shows a side surface of the output shaft 130 on which the first flat portion 28 is provided.

As shown in FIG. 8, the engaging portion 26 is inserted into the through hole 27 so that the output shaft 130 and the impeller 118 are engaged. The engaging portion 26 is provided with the first flat portion 28, and the through hole 27 is provided with the second flat portion 24. The engaging portion 26 has a smaller size than that of the through hole 27. The engaging portion 26 is inserted into the through hole 27 such that the first flat portion 28 faces the second flat portion 24. When the fuel pump is in operation, the output shaft 130 rotates with the first flat portion 28 and the second flat portion 24 being in contact with each other. Due to this, the rotation of the output shaft 130 causes the impeller 118 to rotate integrally with the output shaft 130. That is, provision of the flat portions 24, 28 prevents the output shaft 130 from running idle.

As shown in FIG. 9, the first flat portion 28 is provided on a part of an outer peripheral surface of the engaging portion 26, and extends parallel to the rotational axis CL. As shown in FIG. 10, the first flat portion 28 has a width 28*w* that is smaller than a diameter 26*b* of the engaging portion 26 and is constant along the rotational axis CL direction. Due to this, as shown in FIG. 9, the engaging portion 26 has a size 26*a* at a part thereof where the first flat portion 28 is provided, and the size 26*a* is constant along the rotational axis CL direction. That is, in a cross-section perpendicular to the rotational axis CL of the engaging portion 26, a length (shortest length) between the rotational axis CL and the first flat portion 28 is constant along the rotational axis CL direction. Moreover, the size 26*a* is smaller than a size 24*a* of the though hole 27 at a part where the second flat portion 24 is provided (size 24*a* being, in a cross-section of the through hole 27 perpendicular to a central axis of the impeller 118, a shortest length between the central axis of the impeller and the second flat portion 24). Furthermore, the second flat portion 24 is provided on a part of an inner peripheral surface of the through hole 27, and extends parallel to the central axis of the impeller 118. For this reason, when the output shaft 130 and the impeller 118 are arranged coaxially, a length of a gap between the first flat portion 28 and the second flat portion 24 is constant along the rotational axis CL direction.

As described above, the output shaft 130 and the impeller 118 rotate with the first flat portion 28 and the second flat portion 24 being in contact with each other. Since the size of the engaging portion 26 is smaller than the size of the through hole 27, the impeller 118 rotates titling relative to the output shaft 130. As shown by virtual lines in FIG. 9, when the impeller 118 rotates tilting relative to the output shaft 130, the output shaft 130 and the impeller 118 come into contact at plural spots in the rotational axis CL direction. FIG. 9 shows an example where the first flat portion 28 and the second flat portion 24 make contact at an upper end (motor section 58 side) of the impeller 118 (broken line 90), and respective parts where the flat portions 24, 28 are not provided make contact at a lower end (opposite side from the motor section 58) of the impeller 118 (broken line 92).

The output shaft 130 and the impeller 118 come into contact at the plural spots in the rotational axis CL direction, as a result of which the tilting of the impeller 118 relative to the output shaft 130 is fixed in a certain direction and the movement of the impeller 118 is thereby restricted. For example, contacts in ranges encompassed by the broken lines 90, 92 could continue. As a result of this, there may be a case where the output shaft 130 and the impeller 118 could be stuck to each other, and the impeller 118 could no longer move (tilt) freely relative to the output shaft 130. Consequently, great friction could occur between the impeller 118 and the casing 70 (see FIG. 7), and the impeller 118 and the casing 70 could be worn out.

First Embodiment

Figure 1:
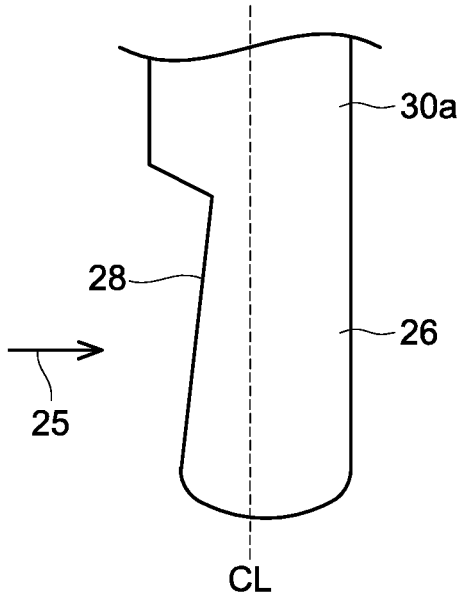
FIG. 1 shows a side surface of an output shaft used in a fuel pump of a first embodiment.
Figure 2:
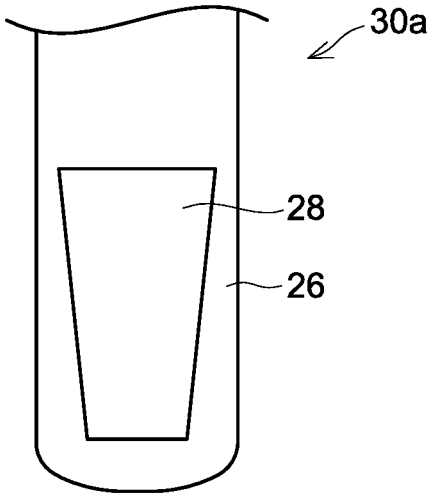
FIG. 2 shows the side surface of the output shaft in FIG. 1 from a different angle.
Figure 3:
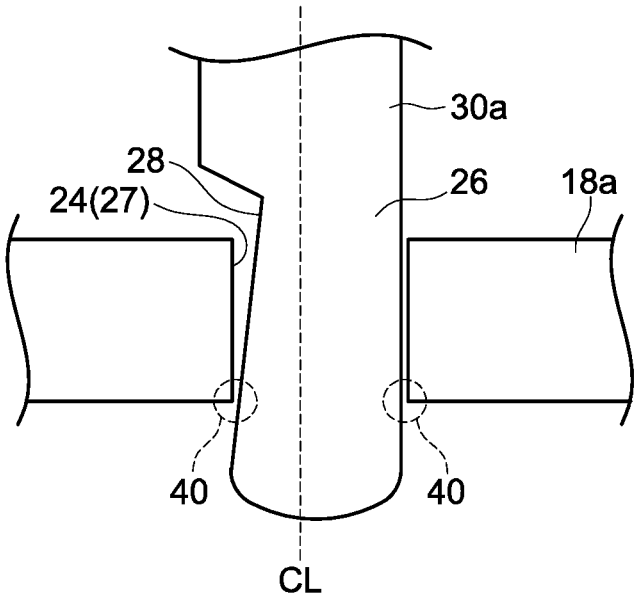
FIG. 3 shows a state where the output shaft is inserted into a through hole of an impeller in the fuel pump of the first embodiment.

With reference to FIGS. 1 to 3, a fuel pump of the present embodiment will be described. It should be noted that, FIGS.

1 and 2 show an output shaft 30*a* of the present embodiment, and FIG. 3 shows a state where the output shaft 30*a* is inserted into a through hole 27 of an impeller 18*a*. The impeller 18*a* has a same shape as the conventional impeller 118 (see FIGS. 8 and 9). Due to this, descriptions of the impeller 18*a* may be omitted. The output shaft 30*a* and the impeller 18*a* can be used as the output shaft 30 and the impeller 18 shown in FIG. 7. It should be noted that FIG. 2 is a drawing that shows the output shaft in FIG. 1 along an arrow 25.

As shown in FIGS. 1 and 2, a part of an outer peripheral surface of an engaging portion 26 of the output shaft 30*a* comprises a first flat portion 28. The first flat portion 28 is formed by removing a part of the outer peripheral surface of the columnar output shaft 30. The first flat portion 28 is for engaging with the impeller 18*a*. A width (length in a direction perpendicular to a rotational axis CL) of the first flat portion 28 becomes narrower as it becomes closer to an end of the output shaft 30*a* (direction away from a motor section 58). Due to this, a thickness (a shortest length between the rotational axis CL and the first flat portion 28 in a cross-section of the engaging portion 26 perpendicular to the rotational axis CL) of the engaging portion 26 at the part where the first flat portion 28 is provided increases as it becomes closer to the end of the output shaft 30*a*. That is, the first flat portion 28 is angled so as to separate away from the rotational axis CL as it becomes closer to the end of the output shaft 30*a*.

As shown in FIG. 3, when the engaging portion 26 is inserted into the through hole 27, a gap between the first flat portion 28 and the second flat portion 24 is narrow on an output shaft 30*a* end side (direction away from the motor section 58 and a side on which an intake port 72 is provided), and the gap between the first flat portion 28 and the second flat portion 24 is wide on an output shaft 30*a* center side (motor section 58 side). That is, when the output shaft 30*a* and the impeller 18*a* are arranged coaxially, spots which have different lengths of the gap between the first flat portion 28 and the second flat portion 24 from each other (narrow on the output shaft 30*a* end side and wide on the output shaft 30*a* center side) exist in the rotational axis CL direction of the output shaft 30*a*. Due to this, when the fuel pump is in operation, the output shaft 30*a* and the impeller 18*a* come into contact (broken line 40 portion) at the lower end of the impeller 18*a* (output shaft 30*a* end side). Even when the impeller 18*a* tilts relative to the output shaft 30*a*, the first flat portion 28 and the second flat portion 24 will not come into contact at an upper end of the impeller 18*a* (output shaft 30*a* center side).

The output shaft 30*a* comprises portions which have different thicknesses of the engaging portion 26 (the shortest lengths between the rotational axis CL and the first flat portion 28 in the cross-section perpendicular to the rotational axis CL) from each other in the rotational axis CL direction. Due to this, as described above, during operation of the fuel pump, a spot where the output shaft 30*a* and the impeller 18*a* make contact can be localized to the spot (lower end) in the rotational axis CL direction. The tilting of the impeller 18*a* relative to the output shaft 30*a* can be prevented from being fixed in a certain direction, as a result of which the impeller 18*a* can move freely relative to the output shaft 30*a*. Consequently, the output shaft 30*a* and the impeller 18*a* are suppressed from being stuck to each other, and wear of the impeller 18*a* and the casing 70 can be reduced.

Second Embodiment

Figure 4:
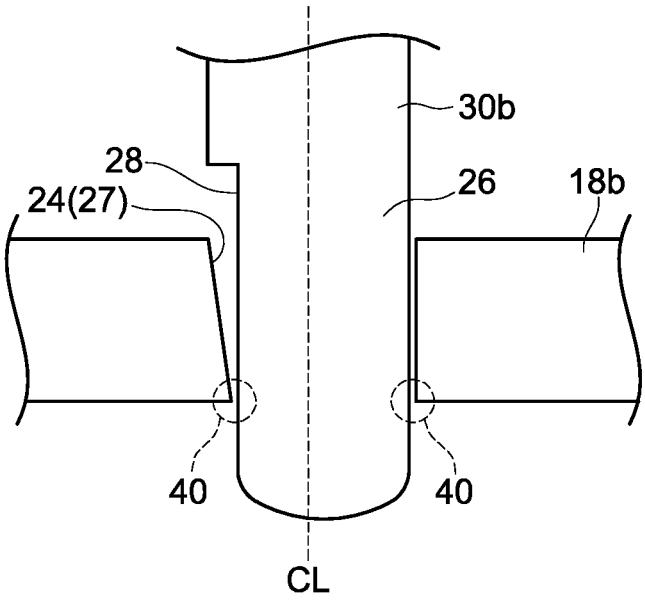
FIG. 4 shows a state where an output shaft is inserted into a through hole of an impeller in a fuel pump in a second embodiment.

A fuel pump according to the present embodiment will be described with reference to FIG. 4. An output shaft 30*b* and an impeller 18*b* shown in FIG. 4 can be used as the output shaft 30 and the impeller 18 shown in FIG. 7. It should be noted that the output shaft 30*b* has a same shape as that of the conventional output shaft 130 (see FIGS. 9, 10). Descriptions of the output shaft 30*b* may be omitted.

In the fuel pump of the present embodiment, a first flat portion 28 of the output shaft 30*b* is not angled relative to the rotational axis CL, but is parallel to the rotational axis CL. A second flat portion 24 of the impeller 18*b* is angled relative to a central axis of the impeller 18*b*. Due to this, in the fuel pump of the present embodiment also, when the output shaft 30*b* and the impeller 18*b* are coaxially arranged, spots which have different lengths of a gap between the first flat portion 28 and the second flat portion 24 from each other in the rotational axis CL direction of the output shaft 30*b* exist. Specifically, the gap between the first flat portion 28 and the second flat portion 24 is narrow on an output shaft 30*b* end side, and the gap between the first flat portion 28 and the second flat portion 24 is wide on an output shaft 30*b* center side. Due to this, when the fuel pump is in operation, the output shaft 30*b* and the impeller 18*b* come into contact (broken line 40 portion) at a lower end of the impeller 18*b*. By not configuring the first flat portion 28 to be angled but configuring the second flat portion 24 to be angled as such, a spot where the output shaft 30*b* and the impeller 18*b* make contact can be localized to the spot in the rotational axis CL direction, as a result of which the output shaft 30*b* and the impeller 18*b* can be suppressed from being stuck to each other, and wear of the impeller 18*b* and the casing 70 can be reduced.

Third Embodiment

Figure 5:
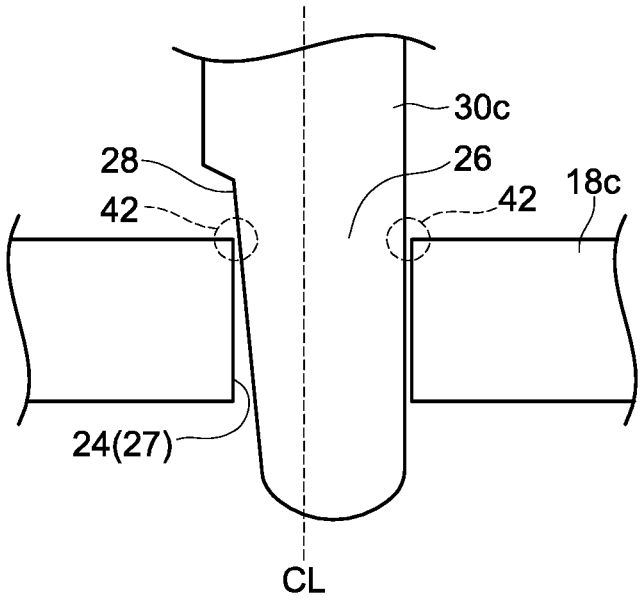
FIG. 5 shows a state where an output shaft is inserted into a through hole of an impeller in a fuel pump in a third embodiment.

With reference to FIG. 5, a fuel pump according to the present embodiment will be described. An output shaft 30*c* and an impeller 18*c* shown in FIG. 5 can be used as the output shaft 30 and the impeller 18 shown in FIG. 7. It should be noted that the impeller 18*c* has a same shape as that of the impeller 18*a* and the impeller 118 (see FIGS. 3, 9). Descriptions of the impeller 18*c* may be omitted.

In the fuel pump according to the present embodiment, a first flat portion 28 of the output shaft 30*c* is angled so as to become closer to a rotational axis CL as the first flat portion 28 becomes closer to an end of the output shaft 30*c*. Due to this, a thickness of an engaging portion 26 at a part where the first flat portion 28 is provided decreases as it becomes closer to the end of the output shaft 30*c*. Due to this, when the fuel pump is in operation, the output shaft 30*c* and the impeller 18*c* come into contact (broken line 42 portion) at an upper end (output shaft 30*c* center side) of the impeller 18*c*. In the fuel pump of the present embodiment also, a spot where the output shaft 30*c* and the impeller 18*c* make contact can be localized to the spot in the rotational axis CL direction, as a result of which the output shaft 30*c* and the impeller 18*c* can be suppressed from being stuck to each other, and wear of the impeller 18*c* and the casing 70 can be reduced.

Fourth Embodiment

Figure 6:
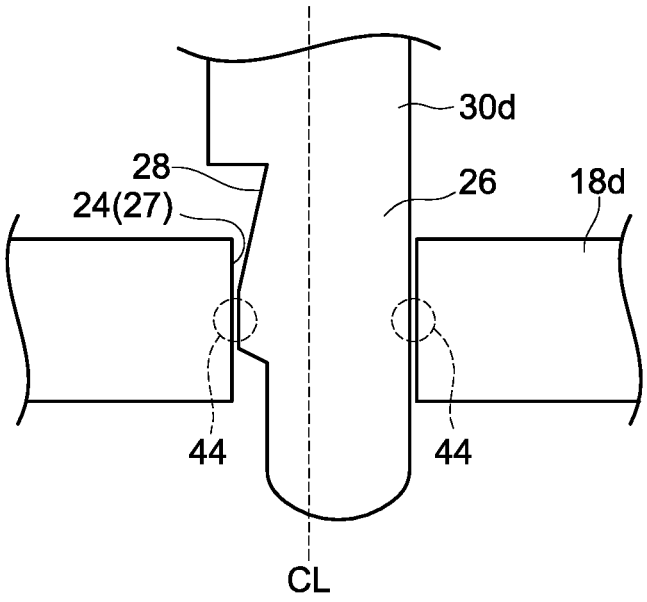
FIG. 6 shows a state where an output shaft is inserted into a through hole of an impeller in a fuel pump in a fourth embodiment.

With reference to FIG. 6, a fuel pump of the present embodiment will be described. An output shaft 30*d* and an impeller 18*d* shown in FIG. 6 can be used as the output shaft 30 and the impeller 18 shown in FIG. 7. It should be noted that the impeller 18*d* has a same shape as that of the impellers 18*a*, 18*c*, and the impeller 118 (see FIGS. 3, 5, and 9). Descriptions of the impeller 18*d* may be omitted.

In the fuel pump of the present embodiment, a first flat portion 28 of the output shaft 30*d* is angled toward an end of the output shaft 30*d* so as to be away from a rotational axis CL, and after a length between the first flat portion 28 and the rotational axis CL reaches its maximum, the first flat portion 28 approaches toward the rotational axis CL. That is, for this reason, a thickness of an engaging portion 26 at a part where the first flat portion 28 is provided is thickest at an intermediate portion of the rotational axis CL direction (intermediate portion of the through hole 27). Due to this, when the fuel pump is in operation, the output shaft 30*d* and the impeller 18*d* come into contact (broken line 44 portion) at the intermediate portion in the through hole 27 of the impeller 18*d*. In the fuel pump of the present embodiment also, a spot where the output shaft 30*d* and the impeller 18*d* make contact can be localized to the spot in the rotational axis CL direction, as a result of which the output shaft 30*d* and the impeller 18*d* can be suppressed from being stuck to each other, and wear of the impeller 18*d* and the casing 70 can be reduced.

Given the above, by localizing the spot where the output shaft (engaging portion) and the impeller make contact in the rotational axis direction of the output shaft, degree of freedom of the impeller movement relative to the output shaft is less restricted, the output shaft and the impeller are suppressed from being stuck to each other, and consequently wear of the impeller and/or casing can be reduced. The spot where the output shaft (engaging portion) and the impeller make contact may be on the upper end side of the impeller, on the lower end side of the impeller, or at the intermediate portion in the through hole.

It should be noted that in the above first to third embodiments, examples where the outer peripheral surface of the output shaft, or the inner peripheral surface of the impeller is angled were described. However, the technology disclosed herein may simply need to have spots which have different lengths of the gap between the first flat portion and the second flat portion from each other exist, and therefore for example, both of the outer peripheral surface of the output shaft and the inner peripheral surface of the impeller through hole may be angled.

Further, the above first to fourth embodiments described an example where one first flat portion is provided on the outer peripheral surface of the output shaft, or an example where one second flat portion is provided on the inner peripheral surface of the through hole of the impeller. Two or more first flat portions may however be provided on an outer peripheral surface of an output shaft. For example, two first flat portions may be provided respectively at opposite locations with a rotational axis CL of an output shaft interposed therebetween. In this case, the two first flat portions may have a same shape, or may have different shapes. Further, in a case where two or more first flat portions are provided on an outer peripheral surface of an output shaft, two or more second flat portions may be also provided on an inner peripheral surface of a through hole of an impeller.

Specific examples of the present invention have been described in detail, however, these are mere exemplary indications and thus do not limit the scope of the claims. The art described in the claims includes modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

The invention claimed is:

1. A fuel pump comprising:

a motor including a motor section and an output shaft extending from the motor section and an impeller configured to rotate integrally with the output shaft, wherein an outer periphery of the output shaft comprises a D-shaped portion for engaging with the impeller, the D-shaped portion defined by a first flat portion connected to an annular portion, the impeller comprises a D-shaped through hole at a center thereof, the D-shaped through hole being larger than an outer shape of the output shaft and defined by a second flat portion connected to a second annular portion for engaging with the D-shaped portion of the output shaft, and when the output shaft and the impeller are arranged coaxially, in a rotational axis direction of the output shaft, a portion exists where a gap between the first flat portion and the second flat portion is narrower than the gap at an end of the motor section.

2. The fuel pump according to claim 1, wherein the output shaft comprises portions which have different lengths between the first flat portion and a rotational axis of the output shaft in the rotational axis direction.

3. The fuel pump according to claim 2, wherein the impeller comprises portions which have different lengths between the second flat portion and a central axis of the impeller in a central axis direction of the impeller.

4. The fuel pump according to claim 1, wherein the impeller comprises portions which have different lengths between the second flat portion and a central axis of the impeller in a central axis direction of the impeller.

* * * * *